US005908678A

United States Patent [19]

Robichon et al.

[11] Patent Number: 5,908,678

[45] Date of Patent: Jun. 1, 1999

[54] LONG-LIFE POLYMER PACKAGING FOR AN ANETHOLE-BASED DRINK AND PROCESS INTENDED TO LIMIT THE LOSS OF ANETHOLE CONTAINED IN A SOLUTION

[75] Inventors: Patrice Robichon, Chatou; Philippe Noble, Beziers, both of France

[73] Assignee: Pernod Ricard, Paris, France

[21] Appl. No.: 08/880,534

[22] Filed: Jun. 23, 1997

[30] Foreign Application Priority Data

Jun. 21, 1996 [FR] France ..... 96 07742

[51] Int. Cl.[6] ..... C08L 33/00

[52] U.S. Cl. ..... 428/35.7; 426/108; 426/116; 220/304; 220/344; 220/795; 220/804

[58] Field of Search ..... 426/108, 116; 428/35.7; 220/304, 795, 344, 804

[56] References Cited

FOREIGN PATENT DOCUMENTS 433097 6/1991 European Pat. Off. .

*Primary Examiner*—Charles Nold

*Attorney, Agent, or Firm*—Jacobson, Price, Holman & Stern, PLLC

[57] ABSTRACT

The invention relates to a monolayer or multilayer long-life packaging containing an anethole-based alcoholic or non-alcoholic drink, characterized in that the layer in contact with the said drink is formed of a methyl acrylate/acrylonitrile/butadiene terpolymer.

The invention also relates to a process intended to limit the degradation of an anethole-based alcoholic or non-alcoholic drink, in particular one which is low in alcohol or alcohol-free, characterized in that the said drinks are stored in a monolayer or multilayer long-life packaging whose layer in contact with the said drinks consists of a methyl acrylate/acrylonitrile/butadiene terpolymer.

17 Claims, 2 Drawing Sheets

Figure 1:
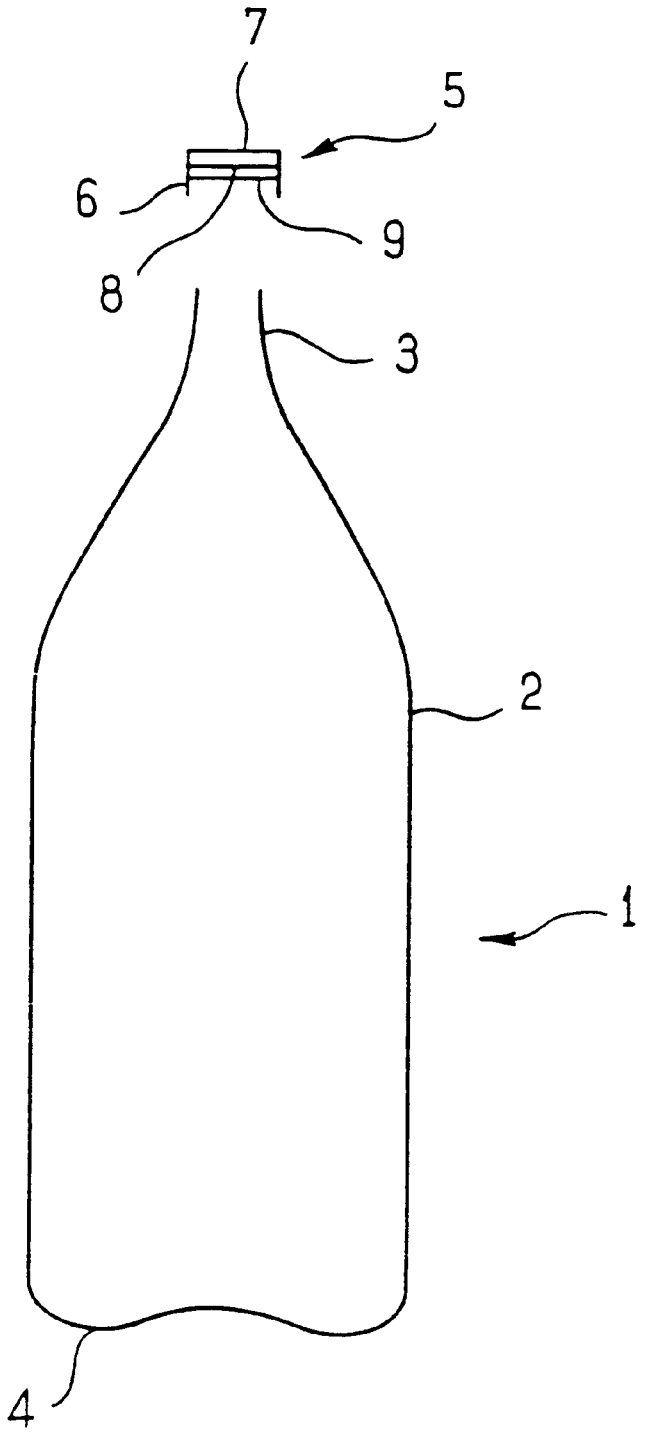

LONG-LIFE POLYMER PACKAGING FOR AN ANETHOLE-BASED DRINK AND PROCESS INTENDED TO LIMIT THE LOSS OF ANETHOLE CONTAINED IN A SOLUTION

The present invention relates to a novel monolayer or multilayer long-life packaging containing an aqueous, alcoholic or non-alcoholic anethole-based drink.

The invention also relates to a process intended to limit the loss of anethole contained in a solution, which may contain alcohol, in contact with the wall of a packaging, as well as to the use of a polymer film to produce a packaging in contact with anethole solutions which may contain alcohol, in order to limit the loss of anethole through contact with the wall of the packaging.

Aniseed-flavored drinks contain anethole, or para-propenylmethoxybenzene, mainly in trans form (greater than 96–97%). Anethole has the particular feature of being very insoluble in water (<50 mg/l) and soluble in alcohol. In the presence of water, anethole becomes cloudy, whereas in a water/alcohol solution with a high alcohol content (from about 45% by volume), the anethole remains dissolved.

In the case of alcohol-free drinks or drinks with a low alcohol content (4–9% by volume), use is made of an emulsifier since the anethole is no longer soluble.

During the conservation of aniseed-flavored drinks, considerable degradation takes place over time, in particular under the action of:

light (cis/trans isomerization), oxidation in the presence of light, interaction between the anethole and the packaging material.

Although it has become possible to overcome the first two drawbacks mentioned above with the aid of ultraviolet-opaque packaging which has a gas-barrier effect, the same cannot be said for the third point regarding the loss of anethole through contact with the packaging material.

Consequently, in the case of the polymer packagings traditionally used (polyethylene, polypropylene, polyvinyl chloride, polyethylene terephthalate), a considerable loss of aroma (up to 100%) is observed over time through contact with the polymer walls, which prevents aniseed-flavored drinks from being marketed in plastic packaging.

The document Ernährung/nutrition, vol. 3n, No. 1, 1979 illustrates, in the table on page 35, the fact that plastics such as polyethylene are not suitable as packaging for anethole-based drinks.

This problem is even more sensitive in the case of alcohol-free drinks or drinks with a low alcohol content that are based on anethole, for which the loss through contact with the polymer is even faster.

Several scientific observations illustrate the particular behavior of this compound.

Anethole has a low coefficient of solubility in water but a high coefficient of solubility in alcohols. This phenomenon is proportionately greater for low-alcohol or alcohol-free drinks. This induces a large electrostatic interaction with the surface of the polymer and the adsorption of the anethole thereon.

Moreover, the affinity of anethole for polymers is such that an absorption phenomenon takes place by insertion of this compound between the chains of the polymer. This is thus a dynamic adsorption/absorption phenomenon.

Anethole moreover reveals a high tendency to polymerize into polyanethole. This cationic-type polymerization is promoted by the highly electron-donating nature of the methoxy group. This phenomenon takes place in particular in the case of the polymers derived from styrene, from maleic anhydride or from acrylo-nitrile that are commonly used as packagings for drinks. This is due to the fact that anethole reacts with the molecular chains of these polymers.

However, anethole may also react with the residual monomers, given the well-known copolymerization reaction with styrene (T. Higashimura et al., Journal of Polymer Science: part A.1, vol. 10, 85–93 (1972)) or the terpolymerization with maleic anhydride and acrylic monomers such as acrylonitrile (T. K. Kobuko et al.,Macromolecules, vol. 3, No. 5, September–October 1970, 518–523).

Consequently, at the present time, the only acceptable packaging for anethole-based drinks is glass packaging and the polymer packagings conventionally used lead over time to a considerable loss of aroma (up to 100%) through contact with the polymer walls, which prevents aniseed-flavored drinks from being marketed in plastic packaging.

Accordingly, aniseed-flavored drinks are currently marketed in glass bottles.

It is thus desirable to propose novel packagings which reach or approach the performance of glass in terms of inertness.

After systematic research, the Applicant Company has developed a novel packaging which is intended to contain aniseed-flavored drinks which may contain alcohol, this packaging having satisfactory characteristics, in particular as regards the absence of sorption of anethole, while at the same time possessing the required qualities of transparency and of low manufacturing cost.

Accordingly, a first subject of the invention is a monolayer or multilayer long-life packaging for a drink which may contain alcohol and which comprises anethole, characterized in that the layer in contact with the said drink is formed of a methyl acrylate/acrylonitrile/butadiene terpolymer.

The term "packaging" will be understood to refer to any packaging which may contain the said drink, whether this packaging is in bottle or carton form or in the form of other equivalent closed systems, including containers made of goatskin and bags.

The term "long-life" means that the shelf life is at least 6 months.

In the context of the present invention, the notion of packaging also covers the means for closing off and making leaktight the various containers referred to above.

The present invention relates in particular to the closure means for any packaging intended to contain an anethole-based drink.

Such a closure means is advantageously provided with an inner film formed of a film of methyl acrylate/acrylonitrile/butadiene terpolymer which is applied to the opening of the said packaging.

This means may consist in particular of a cylindrical capsule inside which is housed an inner film formed of a film of methyl acrylate/acrylonitrile/butadiene terpolymer which is applied to the opening of the said packaging.

The packaging proved to be particularly advantageous in the case of alcohol-free or low-alcohol drinks whose alcohol content is preferably less than 10% by volume, preferably between 3 and 9%.

In a known manner, the aqueous, alcoholic or non-alcoholic drink comprises from 0.01 to 2 g/l of anethole, preferably 0.02 g/l or more of anethole.

In concentrates to be diluted such as the drink known under the name "Pastis", the anethole concentration is about 2 g/l. In ready-to-drink alcoholic drinks, it is from about 200 to 400 mg/l. In the case of aniseed-flavored drinks, it is from about 10 to 50 mg/l.

It will be recalled that for drinks containing 45% alcohol by volume, the anethole is fully dissolved, whereas, for alcohol-free or low-alcohol drinks (4–9% by volume), use is made of an emulsifier in order to keep the anethole dissolved.

Among the above mentioned terpolymers which are suitable in the context of the present invention, those having an oxygen-permeability of less than 0.8 $cm^3.mm/m^2.day$ bar at 23° C. and at a relative humidity of 100% will be preferred.

These materials are commercially available or may be obtained by those skilled in the art in a known manner.

Preferably, the terpolymer has a butadiene content of between 8 and 20%.

Advantageously, the terpolymer is chosen from the group consisting of the terpolymer whose butadiene content is about 10% and the terpolymer whose butadiene content is about 18%.

These polymers are marketed by the company BP Chemicals under the tradenames Barex 210® and Barex 218® respectively.

The polymer Barex 210® has an oxygen-permeability of 0.3 $cm^3.mm/m^2.day.bar$ at 23° C.

The polymer Barex 218® has an oxygen0permeability of 0.6 $cm^3.mm/m^2.day.bar$ at 23° C.

These polymers are already used as packaging for various products such as cosmetic items, domestic chemical products and items for medical use.

They are also used for certain products for consumption such as table oils, essential oils, spices and vinaigrette sauces. However, all the products which have been packaged to date with such polymers do not possess the intrinsic properties of anethole on account of the specific chemical and physical nature of this compound.

Therefore, it would not have been obvious to deduce the noteworthy performance of these materials with regard to anethole from these data.

The document EP-A-433,097 describes a container made of a resin, which is similar to that described in the present invention, for packaging drinks such as water, tea, coffee, fruit juices and grape juices. That document neither describes nor suggests the use of that resin for packaging anethole-based drinks.

In general, besides the characteristics of providing a barrier to anethole, films formed of a methyl acrylate/acrylonitrile/butadiene terpolymer should be sufficiently impermeable to carbon dioxide. They should also have a tear strength and a modulus of elasticity that are sufficient for the application considered.

The packaging may be in the form of a monolayer or in the multilayer form.

In the case of multilayer packaging, the inner layer is formed of a film of methyl acrylate/acrylonitrile/butadiene terpolymer. The film is associated with a structural material which is itself optionally multilayered (metal, cardboard, mono- or multilayer polymer material).

The thickness of the layer of terpolymer may vary considerably depending on whether the packaging is monolayer or multilayer. It will preferably be between 200 and 500 $\mu$m, advantageously between 300 and 400 $\mu$m, but may be as low as 50 $\mu$m for films and be up to 1 mm or more for large packaging (vats, etc.).

The implementation of such polymers is carried out on a usual extrusion-blowing machine, such as that used for PVC with or without bi-orientation.

Such an implementation is therefore inexpensive and does not require the use of a machine which is specific to the product.

The packagings are thus in the form of a monolayer or multilayer material obtained by extrusion.

The packagings according to the invention may conserve an anethole-based drink, in particular one which is low in alcohol or alcohol-free, under the same conditions as a glass bottle, that is to say without substantial degradation of the organoleptic qualities.

Furthermore, they are transparent in the case of monolayer packaging or multilayer packaging in which the structural layers are transparent, are easy to transform and are inexpensive.

The invention also relates to a closure means especially for the said packaging, provided with an inner film made of an anethole-impermeable material, in particular a polymer formed of a methyl acrylate/acrylo-nitrile/butadiene terpolymer, which is applied to the said packaging.

All the variants indicated above relating to the packaging also apply to the said closure means.

This closure means is, in particular, a cylindrical capsule inside which is housed an inner film of a polymer as defined above.

A bottle shown in longitudinal section is represented in the appended FIG. 1, in which the bottle 1 formed of a cylindrical body 2, a neck 3 and a base 4 consists of a polymer material made of methyl acrylate/acrylonitrile/butadiene terpolymer.

The bottle is 0.2 mm thick in the cylindrical body and 0.6 mm thick in the base.

The capsule 5 is formed of a cylindrical body 6 and of a circular base 7. Inside the capsule 5 is housed a disc 8 formed of a layer made of methyl acrylate/acrylonitrile/butadiene terpolymer 8 which is applied to the inner face of the base, and a layer made of methyl acrylate/acrylonitrile/butadiene terpolymer 9 which supports the neck 3.

The invention also relates to the use of a methyl acrylate/acrylonitrile/butadiene terpolymer as described for the preparation of a monolayer or multilayer packaging intended to contain anethole-based drinks which may contain alcohol, in order to limit the degradation of these drinks, the said terpolymer forming the layer in contact with the said drinks.

The invention also relates to a process intended to limit the degradation of anethole-based drinks, in particular those which are low in alcohol or alcohol-free, characterized in that the said drinks are stored in a monolayer or multilayer long-life packaging whose layer in contact with the said drinks consists of a methyl acrylate/acrylonitrile/butadiene terpolymer as defined above.

The invention is now illustrated by the examples, given for illustrative purposes, which follow.

EXAMPLE 1

Bottles consisting of a monolayer of Barex 218® marketed by the company BP Chemicals, with an average thickness of 350 $\mu$m, were made by transformation on a bi-orientation extrusion-blowing machine for PVC.

The bottles are filled while cold, in the presence of a bacteriostat, with an alcohol-free aniseed-flavored solution containing 400 mg/l of anethole and are then left for 12 months at 20° C.

The loss of anethole is evaluated periodically. It is observed that after 9 months, the loss of anethole is 25% and that after one year, this loss is 28%. A threshold is thus observed of 9 months onwards, the loss of anethole having changed very little since that time.

EXAMPLE 2 COMPARATIVE

Shaped bottles made of polyethylene terephthalate are filled with the same solution as that of Example 1 and are left for 12 months at 20° C.

The loss of anethole is evaluated periodically. It is observed that after 6 months, the loss is 92% and is 100% after 12 months.

Figure 2:
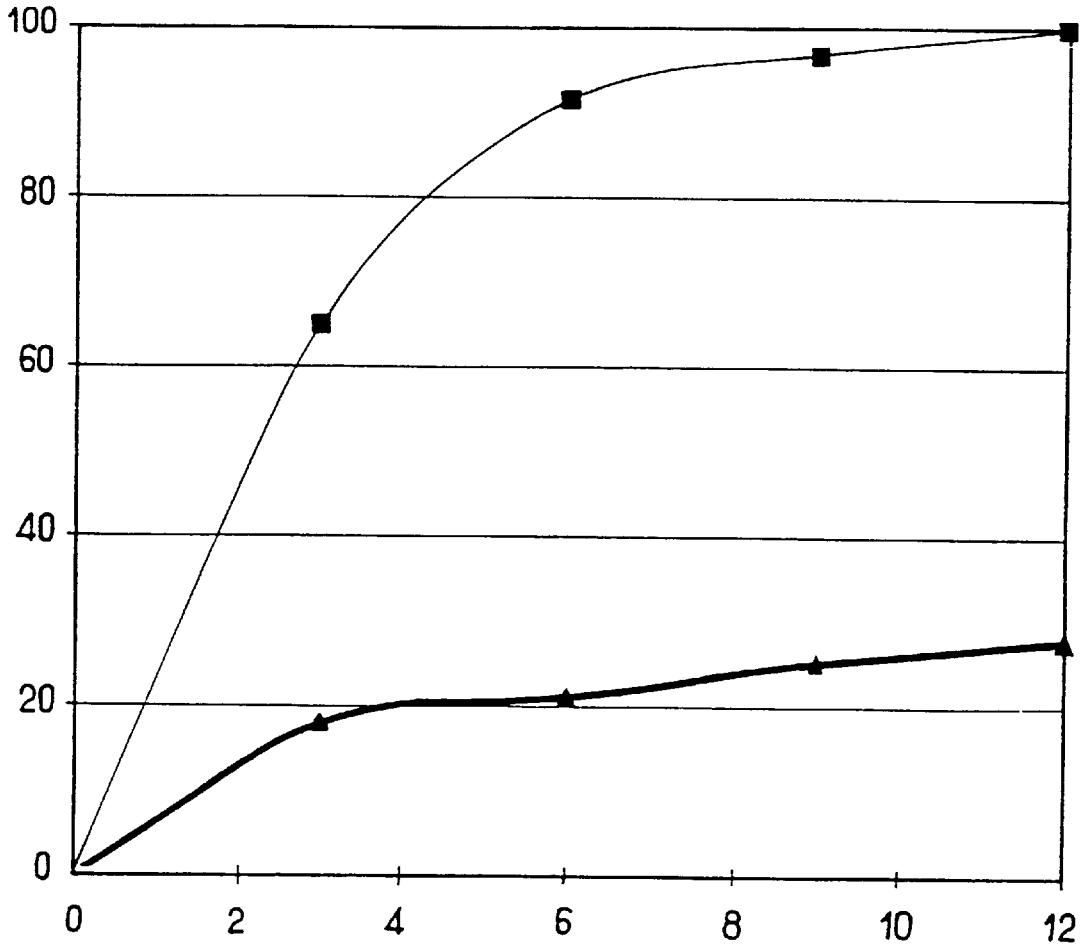

The results are summarized in the table below and in the appended FIG. 2 which shows the percentage loss of anethole in months (Barex 218®, PET ).

| Months | 0 | 3 | 6 | 9 | 12 |
|---|---|---|---|---|---|
| Barex % ® | 0 | 18 | 21 | 25 | 28 |
| PET % | 0 | 65 | 92 | 97 | 100 |

EXAMPLE 3 COMPARATIVE

An example similar to Example 1 was carried out with bottles made of polyethylene marketed by the company Pampryl (France) for fruit juices and with bottles made of polypropylene.

A loss of greater than 90% is observed after 6 months, and of 100% after 12 months.

EXAMPLE 4 COMPARATIVE

An example similar to Example 3 is carried out with a PVC bottle.

A loss of greater than 90% is observed after 6 months, and of 100% after 12 months.

We claim:

1. Monolayer or multilayer long-life packaging containing an anethole-based alcoholic or non-alcoholic drink, characterized in that the layer in contact with the said drink is formed of a methyl acrylate/acrylonitrile/butadiene terpolymer.

2. Packaging according to claim 1, characterized in that the methyl acrylate/acrylonitrile/butadiene terpolymer has an oxygen-permeability of less than 0.8 $cm^3.mm/m^2.day.bar$ at 23° C. and at a relative humidity of 100%.

3. Packaging according to claim 1, characterized in that the terpolymer has a butadiene content of between 8 and 20%.

4. Packaging according to claim 3, characterized in that the terpolymer is chosen from the group consisting of the terpolymer whose butadiene content is about 10% and the terpolymer whose butadiene content is about 18%.

5. Packaging according to claim 1, characterized in that the terpolymer layer is between 50 $\mu$m and 1 mm in thickness.

6. Packaging according to claim 1, characterized in that it is in the form of a multilayer whose inner layer is formed of a film of methyl acrylate/acrylonitrile/butadiene terpolymer, the said inner layer being associated with a structural material which is optionally multilayered.

7. Packaging according to claim 6, characterized in that the structural material is chosen from the group consisting of metal, cardboard and a mono- or multilayer polymer material.

8. Packaging according to claim 1, characterized in that it is in the form of a bottle.

9. Packaging according to claim 1, characterized in that the drink is alcohol-free or low in alcohol.

10. Packaging according to claim 9, characterized in that the drink comprises up to 10% alcohol by volume.

11. Packaging according to claim 10, characterized in that the drink comprises 3 to 9% alcohol by volume.

12. Packaging according to claim 1, characterized in that the aqueous, alcoholic or non-alcoholic drink comprises 0.01 to 2 g/l of anethole.

13. Packaging according to claim 12, characterized in that the aqueous, alcoholic or non-alcoholic drink comprises 0.02 to 2 g/l of anethole.

14. Closure means for packaging according to claim 1, provided with an inner film formed of a film of methyl acrylate/acrylonitrile/butadiene terpolymer which is applied to the opening of the said packaging.

15. Closure means according to claim 14, characterized in that it consists of a cylindrical capsule inside which is housed an inner film formed of a film of methyl acrylate/acrylonitrile/butadiene terpolymer which is applied to the opening of the said packaging.

16. Use of a methyl acrylate/acrylonitrile/butadiene terpolymer according to claim 1, for the preparation of a monolayer or multilayer packaging intended to contain anethole-based drinks which may contain alcohol, according to claim 1, in order to limit the degradation of these drinks, the said terpolymer forming the layer in contact with the said drinks.

17. Process intended to limit the degradation of anethole-based drinks, in particular those which are low in alcohol or alcohol-free, characterized in that the said drinks are stored in a monolayer or multilayer long-life packaging whose layer in contact with the said drinks consists of a methyl acrylate/acrylonitrile/butadiene terpolymer according to claim 1.

* * * * *